US009378910B2

(12) United States Patent
Nguyen et al.

(10) Patent No.: US 9,378,910 B2
(45) Date of Patent: Jun. 28, 2016

(54) THERMAL CUT-OFF DEVICE

(71) Applicant: Therm-O-Disc, Incorporated, Mansfield, OH (US)

(72) Inventors: Truong Nguyen, Wooster, OH (US); George Clark, Lewis Center, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 302 days.

(21) Appl. No.: 14/044,322

(22) Filed: Oct. 2, 2013

(65) Prior Publication Data

US 2015/0091689 A1 Apr. 2, 2015

(51) Int. Cl.

| | |
|---|---|
| ***H01H 37/32*** | (2006.01) |
| ***H01H 85/055*** | (2006.01) |
| ***H01H 85/44*** | (2006.01) |
| ***H01H 1/06*** | (2006.01) |
| ***H01H 37/76*** | (2006.01) |

(52) U.S. Cl.

CPC ..... *H01H 37/32* (2013.01); *H01H 1/06* (2013.01); *H01H 37/765* (2013.01); *H01H 85/055* (2013.01); *H01H 85/44* (2013.01)

(58) Field of Classification Search

CPC ..... H01H 1/06; H01H 37/32; H01H 37/765; H01H 85/44; H01H 85/055

USPC ..... 337/298, 401, 407, 416

See application file for complete search history.

(56) References Cited

U.S. PATENT DOCUMENTS

| | | | | | |
|---|---|---|---|---|---|
| 3,281,559 | A | * | 10/1966 | Ebensteiner | H01H 37/765 337/403 |
| 3,519,972 | A | * | 7/1970 | Phillip | H01H 37/765 337/403 |
| 4,065,741 | A | * | 12/1977 | Sakamoto | H01H 37/70 337/407 |
| 4,167,724 | A | * | 9/1979 | McCaughna | H01H 37/765 337/407 |
| 4,246,564 | A | * | 1/1981 | Olson | H01H 37/765 337/408 |
| 5,473,303 | A | * | 12/1995 | Hohider | H01H 37/765 337/401 |
| 5,530,417 | A | * | 6/1996 | Hohider | H01H 37/765 200/239 |

(Continued)

FOREIGN PATENT DOCUMENTS

| | | |
|---|---|---|
| JP | 2012 248490 | 12/2012 |
| WO | WO 2013/077286 | 5/2013 |

OTHER PUBLICATIONS

"Microtemp® Thermal Cutoffs", Themodisc Product Catalog [PDT Catalog Jun. 2003], 2003, p. 133-152.

(Continued)

*Primary Examiner* — Anatoly Vortman

(74) *Attorney, Agent, or Firm* — Harness, Dickey & Pierce, P.L.C.

(57) ABSTRACT

A thermal cut-off device can include a case, a first electrically conductive lead disposed at a first end of the case, a thermally responsive pellet housed within the case, a second electrically conductive lead disposed at a second end of the case and having a distal end including a contact surface, an electrically conductive contact disposed between the pellet and the second lead, a first biasing member disposed between the pellet and the contact, and a second biasing member disposed between the contact and the second end of the case.

11 Claims, 7 Drawing Sheets

(56) References Cited

U.S. PATENT DOCUMENTS

| | | | | |
|---|---|---|---|---|
| 6,673,257 | B1 | 1/2004 | Hudson | |
| 7,323,965 | B2 * | 1/2008 | Yoshikawa | H01H 37/765 337/159 |
| 7,323,966 | B2 * | 1/2008 | Yoshikawa | H01H 37/765 337/401 |
| 7,330,098 | B2 * | 2/2008 | Yoshikawa | H01H 37/765 337/401 |
| 7,362,208 | B2 * | 4/2008 | Yoshikawa | H01H 37/765 337/388 |
| 7,843,307 | B2 * | 11/2010 | Yoshikawa | H01H 37/765 337/298 |
| 2014/0306794 | A1 | 10/2014 | Yoshikawa | |

OTHER PUBLICATIONS

Extended European Search Report for EP 14187556.7, dated Feb. 4, 2015; EPO.

* cited by examiner

THERMAL CUT-OFF DEVICE

FIELD

The present disclosure relates to thermal cut-off devices that provide protection against overheating by interrupting an electrical circuit.

BACKGROUND

This section provides background information related to the present disclosure which is not necessarily prior art.

Operating temperatures for electrical devices, including appliances, electronics, motors and the like typically have an optimum or preferred range, above which damage can occur to the device or its components, or safely operating the device becomes a concern. Various known devices are capable of protecting against over-temperature conditions by interrupting the electrical current in the device.

One device particularly suitable for over-temperature protection and current interruption is known as a thermal cut-off (TCO) device. A TCO device is typically installed in an electrical application between the current source and electrical components, such that the TCO device is capable of interrupting the circuit continuity in or to a device in the event of an undesirable over-temperature condition. TCO devices are often designed to shut off the flow of electric current to the application in an irreversible manner, without the option of resetting the TCO device current interrupting device.

An exemplary TCO device known in the art is illustrated in FIG. 1. In general, the TCO device 100 includes a conductive metallic case or housing 102 having a first electrical conductor or lead 104 in electrical contact with a closed first end 106 of the case 102. An isolation bushing 108, such as a ceramic bushing, is disposed in an opening of the case 102. The case 102 further includes a retainer edge 110, which secures the isolation bushing 108 within a second end 112 of the case 102. A second electrical conductor or isolated lead 116 is at least partially disposed within the case 102 through an opening 118 in the second end 112 of the case 102. The second electrical conductor 116 passes through the isolation bushing 108 and has an enlarged distal end 120 disposed against one side of the isolation bushing 108 and a second end 122 projecting out of the outer end of the isolation bushing 108. A seal 124 is disposed over the opening 118 and can create sealing contact with the case 102, the isolation bushing 108, and the exposed portion of the second end 122 of the second electrical conductor 116. In this manner, an interior portion of the case 102 is substantially sealed from the external environment.

An electric current interruption assembly 114 for actuating the device in response to a high temperature, for example, is generally disposed between the first and second electrical conductors. The current interruption assembly 114 actuates or "trips" to break the continuity of an electric circuit through the TCO device 100. The current interruption assembly includes a moveable, sliding contact member 126 formed of electrically conductive material, such as a metal. The sliding contact member 126 is disposed inside the case 102 and is disposed in peripheral sliding engagement with the internal surface of the case 102 to provide electrical contact therebetween. Moreover, when the TCO device is operating at a temperature that is below its predetermined threshold set-point temperature, the sliding contact member 126 is disposed in electrical contact with the distal end 120 of the second electrical conductor 116.

The current interruption assembly 114 also includes a biasing means. The biasing means biases the sliding contact member 126 against the distal end 120 of the second electrical conductor 116 to establish electrical contact in a first operating condition where operating temperatures are below the threshold set-point temperature of the TCO device. As shown in the Figures, the biasing means includes first and second compression springs 128, 130, each having a different spring rate, which are respectively disposed on opposite sides of the sliding contact member 126. Two disk members 131, 133 are disposed on opposite sides of the first compression spring 128. The disk members act to substantially evenly distribute the bias of the first compression spring 128.

Also included in the current interruption assembly 114 is a thermally responsive member 132 which, when in a solid physical state, can take the form of a pellet. The solid thermally responsive member 132 is disposed in the case 102 and occupies a volume at the first end 106. The first compression spring 128 of the current interruption assembly 114 is disposed between the thermally responsive member 132 and the sliding contact member 126 and biases the sliding contact member 126 toward engagement with the second electrical conductor 116. The second compression spring 130 is disposed between the sliding contact member 126 and the isolation bushing 108 and biases the sliding contact member 126 away from engagement with the second electrical conductor 116. Because the first compression spring 128 has a greater bias than the second compression spring 130, a net force acts against the sliding contact member 126 to urge the sliding contact member 126 into contact and electrical engagement with the enlarged distal end 120 of the second electrical conductor 116. In this manner, an electrical circuit is established through the TCO device by the first electrical conductor 104, through the electrically conductive case 102, to the sliding contact member 126, and to the second electrical conductor 116.

The thermally responsive member 132 has a reliably stable solid phase at a first operating condition where the operating temperature of the device in which the TCO device is incorporated or the temperature of the surrounding environment, for example, is below a predetermined threshold set-point temperature. The solid thermally responsive member 132, however, reliably transitions to a different physical state when the operating temperature meets or exceeds the threshold set-point temperature in a second operating condition. Under such conditions, the thermally responsive member, e.g., melts, liquefies, softens, volatilizes, or otherwise transitions to a different physical state such that it cannot oppose the force of the biasing means.

With further reference to FIG. 2, a portion of the second electrical conductor 116 is illustrated in greater detail. The second electrical conductor 116 includes a shaft portion 134 terminating at the distal end 120. The distal end 120 has a contact surface 138 at one end and a shoulder 140 at an opposite end adjacent to the shaft portion 134. Referring again to FIG. 1, the distal end 120 of the second electrical conductor 116 abuts the sliding contact member 126 at the contact surface 138 to close the electric circuit through the TCO under conditions when operating temperatures are below the threshold set-point temperature of the TCO device. The contact surface 138 has a convex, hemispherical shape such that only the most distal portion of distal end 120 of the second electrical conductor 116 comes into contact with the sliding contact member 126 to close the electric circuit. Consequently, even under the best of circumstances, only a very small surface area of the second electrical conductor 116 and the sliding contact member 126 engage to close the electric circuit.

Under conditions where the operating or ambient temperature meets or exceeds the TCO device's threshold set-point temperature, the thermal pellet transitions to a different physical state such that it no longer occupies the volume at the first end 106 of the case 102. As such, the first compression spring 128 expands to occupy the space formerly occupied by the thermal pellet 132. In doing so, the first compression spring 128 no longer biases the sliding contact member 126 into engagement with the second electrical conductor 116 with enough force to overcome the bias of the second compression spring 130. Consequently, the bias of the second compression spring 130 forces the sliding contact member 126 out of engagement with the second electrical conductor 116, thereby interrupting the electric circuit in the TCO device.

TCO devices are known to have an element of self-heating ($I^2R$ heating) when they carry electrical current. A reduction in this self-heating would improve the TCO device's operating by allowing it to run at a cooler temperature away from the TCO device's threshold set-point temperature and the phase transition temperature of the thermal pellet. Also, the continued evolution of the TCO device's design requires changes in its construction, such as material options, plating thicknesses, contact systems, etc. In several instances, prior attempts to change these features to improve the TCO device have resulted in unfavorable shifts in the performance of the TCO device.

SUMMARY

This section provides a general summary of the disclosure, and is not a comprehensive disclosure of its full scope or all of its features.

In one aspect, the present disclosure provides a thermal cut-off device including a case extending along a longitudinal axis from a first end to a second end. A first electrically conductive member is disposed at the first end of the case and extends from the case along the longitudinal axis. A thermally responsive member comprises a non-electrically conductive material that transitions from a solid physical state to a non-solid physical state at or above a threshold temperature. A second electrically conductive member is disposed at the second end of the case and extends from the case along the longitudinal axis. The second electrically conductive member includes a contact surface at a distal end. An electrically conductive, moveable contact is disposed between the thermally responsive member and the second electrically conductive member. A first biasing member is disposed between the thermally responsive member and the moveable contact. The first biasing member biases the moveable contact in a direction along the longitudinal axis toward the second electrically conductive member. A second biasing member is disposed between the moveable contact and the second end of the case. The second biasing member biases the moveable contact along the longitudinal axis away from the second electrically conductive member. The distal end of the second electrically conductive member has a concave portion and the contact surface has a generally flat, annular portion that encircles a periphery of the distal end. Below the threshold temperature, the annular portion of the contact surface directly engages the moveable contact.

In another aspect, the concave portion can be located near a central portion of the distal end of the second electrically conductive member and the second electrically conductive member does not engage the moveable contact at the central portion. Further, the distal end can include a shoulder portion opposite the contact surface. The diameter of the shoulder portion can be greater than a diameter of the contact surface. In another aspect, the diameter of the shoulder portion can be less than a diameter of the contact surface.

The thermally responsive member can be an organic compound, and below the threshold temperature it can be a solid in the form of a pellet. As a solid it can oppose the bias of the first biasing member and of the second biasing member such that the movable contact is biased into engagement with the second current conducting member. Above the threshold temperature, the thermally responsive member can be a liquid or a gas and no longer opposes the bias of the first biasing member and the second biasing member. As such, the moveable contact is biased out of engagement and moves away from the second current conducting member.

In still another aspect of the disclosure, the thermal cut-off device includes a first disk disposed between the thermally responsive member and the first biasing member, and a second disk disposed between the first biasing member and the moveable contact.

In yet another aspect of the disclosure, a thermal cut-off device for interrupting an electric circuit at a threshold temperature has a case, first and second leads and a current interruption assembly. The current interruption assembly includes a movable, electrically conductive contact engaging an interior wall of the case and being biased against a contact surface of the second lead at a temperature below the threshold temperature. The distal end of the second lead can include a concave portion and the contact surface can include a generally flat portion about a perimeter of the distal end of the second lead. The concave portion can be located near a central portion of the distal end of the second lead. The contact surface does not engage the contact at the central portion.

In still another aspect of the disclosure a thermal cut-off device has a case, first and second leads and a current interruption assembly. The contact surface comprises a convex portion and the contact comprises a concave portion. The convex portion and the concave portion have substantially the same radius of curvature so that the convex portion and the concave portion can closely correspond to one another. The convex portion and the concave portion can engage one another in a nesting relationship. A disk member located adjacent to the contact can include a second concave portion and the contact can further include a second convex portion opposite to the concave portion. The second concave portion can closely correspond to the second convex portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. The example embodiments are provided so that the disclosure thoroughly conveys the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments can be embodied in many different forms and that neither should be construed to limit the scope of the disclosure. In some example embodiments, well-known processes, well-known device structures, and well-known technologies are not described in detail.

Figure 1:
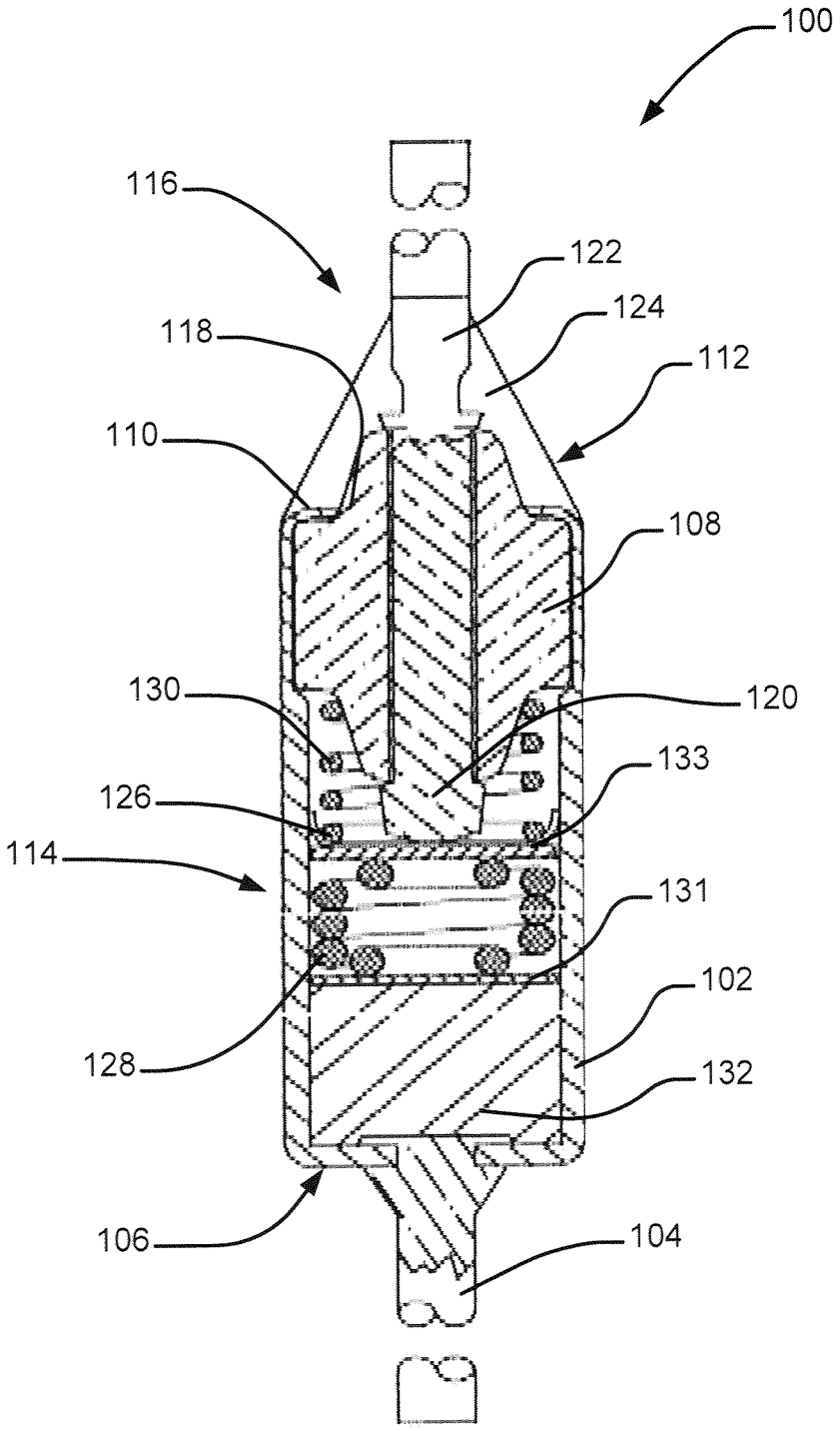
FIG. 1 (Prior Art)
FIG. 1 is a front cross-sectional view of a prior art thermal cut-off device.
Figure 2:
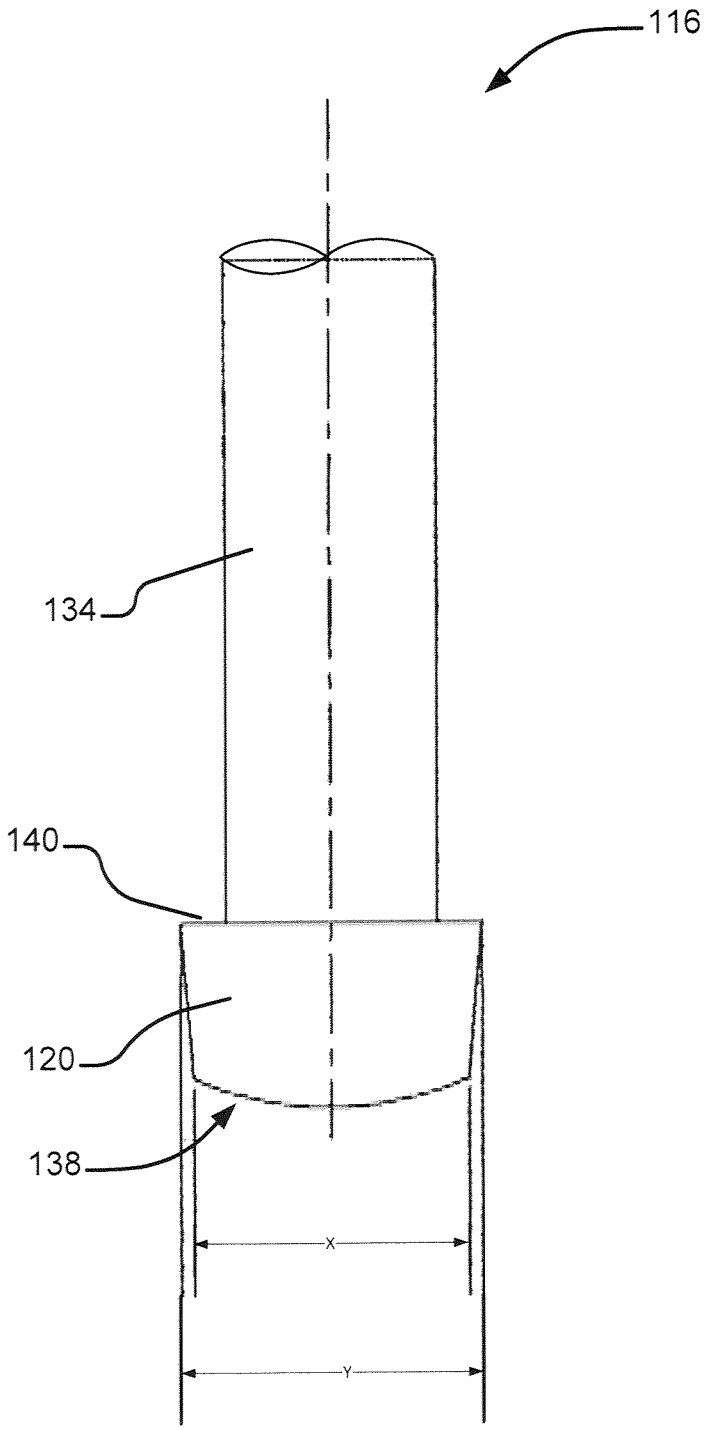
FIG. 2 (Prior Art)
FIG. 2 is a front view of an isolated electrical contact of the thermal cut-off device of FIG. 1 cut-off.
Figure 3:
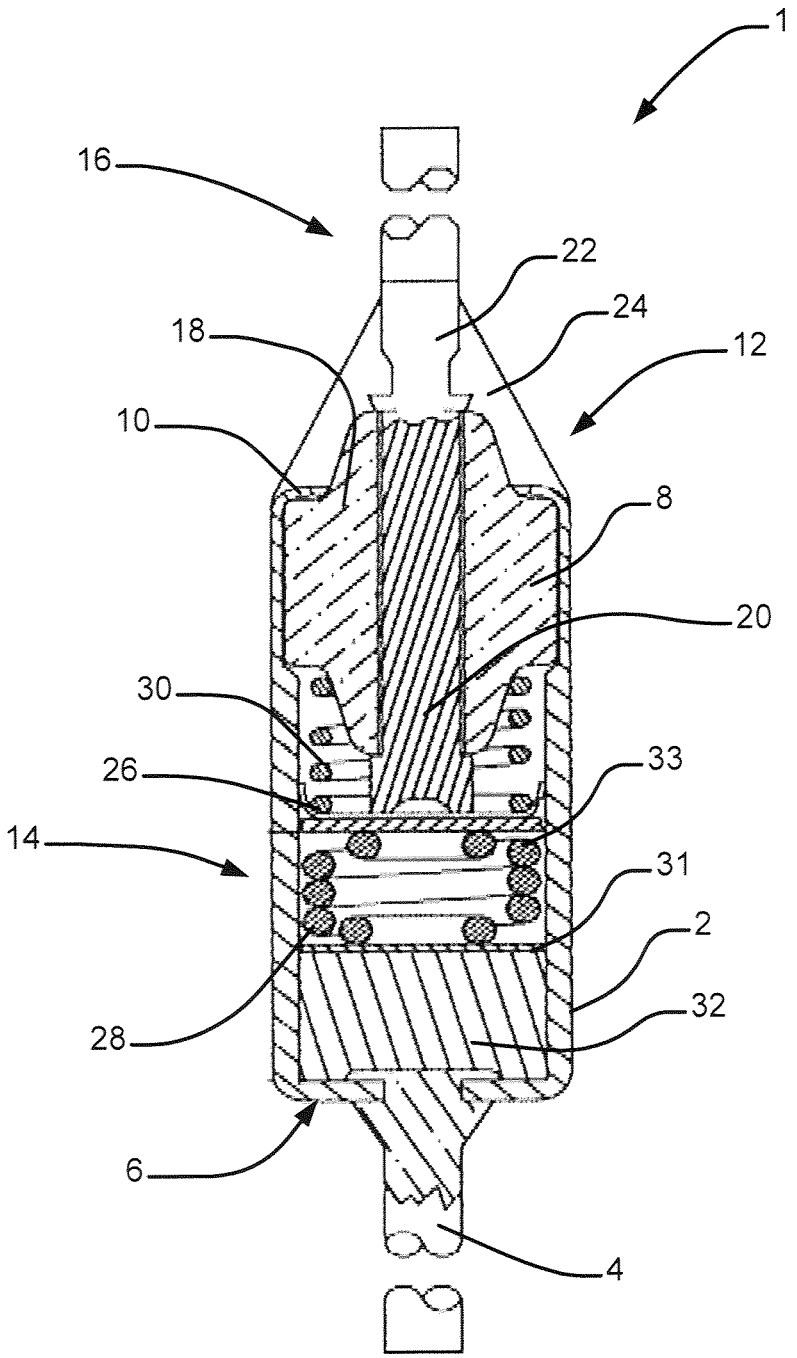
FIG. 3 is a cross-sectional front view of a first thermal cut-off device according to the principles of the present disclosure.

Referring to FIG. 3, a thermal cut-off device according to the principles of the present disclosure is generally indicated at 1. In general, the TCO device 1 shares a construction similar to the TCO device 100 shown in FIG. 1. Consequently, like reference numerals identify the like components of TCO device 1. In FIG. 3, the TCO device 1 is shown in a normal operating state (e.g., under normal operating conditions, including temperature) where an electric circuit is closed between the first electrical conductor 4 and the second electrical conductor 16. Under normal operating conditions, the thermal pellet 32 is in a solid phase and, thus, occupies the volume at the first end 6 of the case 2. The first compression member 28 is, therefore, compressed between the thermal pellet 32 and the sliding contact member 26, biasing the sliding contact member 26 against the second electrical conductor 16 to close the circuit between the first electrical conductor 4, through the case 2, through the sliding contact member 26, and to the second electrical conductor 16.

The TCO device 1 provides protection against overheating by interrupting the electric circuit between the first electrical conductor 4 and the second electrical conductor 16 when the TCO device 1 experiences a temperature that meets or exceeds a threshold cut-off temperature, such as a predetermined operating temperature. When the temperature of the TCO device 1 meets or exceeds the threshold cut-off temperature, the electric current interrupter assembly 14 actuates and breaks the continuity of the electric circuit. The threshold cut-off temperature for the TCO device 1 can be based on the physical properties of the thermal pellet 32, the spring rates and the relaxed lengths of the first and second compression members 28, 30, and the spacing and tolerance stack-up between the several components of the TCO device 1.

Figure 4B:
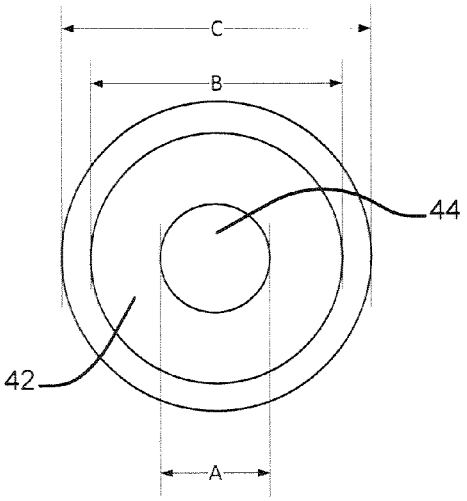
FIGS. 4A and 4B are orthogonal views of an electrical conductor of the thermal cut-off device of FIG. 3.
Figure 4A:
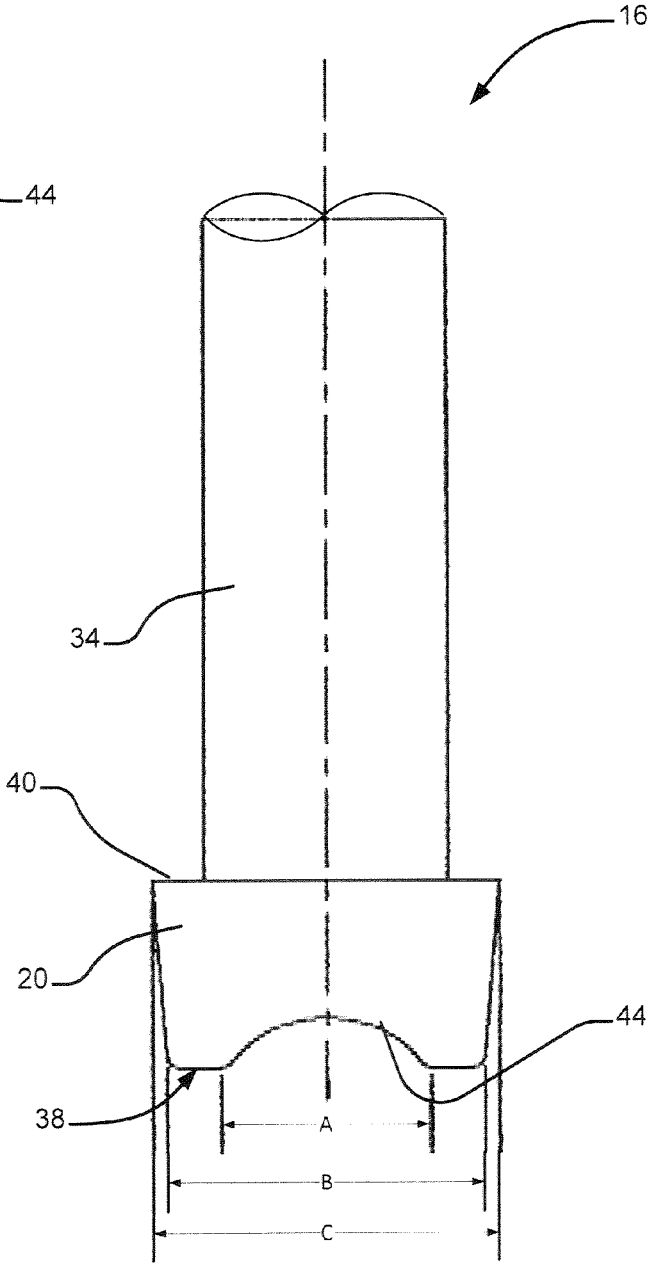

FIGS. 4A and 4B show views detailing a second electrical conductor 16 for the TCO device 1, according to the principles of the present invention. The second electrical conductor 16 includes a shaft portion 34 and a distal end 20. The distal end 20 has a shoulder portion 40 at an end adjacent to the shaft portion 34. A distal end 20 includes a contact surface 38. As shown in FIGS. 4A and 4B, the contact surface 38 comprises a generally flat, annular portion 42 that encircles the periphery of the distal end 20 of the second electrical conductor 16. The annular portion 42 of the contact surface 38 results from an indentation in the distal end 20 that creates a central concave portion 44. The annular portion 42 of the contact surface 38 is operable to engage the sliding contact member 26. The resulting surface area of the contact surface 38 that engages the sliding contact member 26 (i.e., the surface area of the annular portion 42) is significantly increased over prior known TCO devices.

The increased surface area provides performance improvements and manufacturing benefits not available in prior known TCO device designs. For example, the TCO device's manufacturability and assembly process is improved by the relatively large annular portion 42 of the contact surface 38 (e.g., instead of the minimal contact achieved in prior known devices) that engages the sliding contact member 26 and supports and stabilizes the sliding contact member 26 during assembly of the TCO device 1. The increased contact surface area also decreases the current density in the circuit at the contact area between the sliding contact member 26 and the second electrical conductor 16. This reduces the resistance in the electric circuit at the contact surface 38 and across the TCO device, generally. For example, a reduction in the resistance across the TCO device on the order of 10-15% can be achieved. The reduction in resistance improves the aging performance of the TCO device 1. Moreover, the reduction in resistance at the contact surface 38 enables the case 2 of the TCO device 1, which forms part of the electric circuit through the TCO device 1, to be manufactured from a material having a lower copper content than that used in prior known TCO devices, which results in a significant reduction in the material costs for the TCO device 1.

As illustrated in FIG. 4B, the annular portion 42 can further have an inner dimension A defined by the concave portion 44 and an outer dimension B. The shoulder portion 40 can have an outer dimension C. As illustrated in FIG. 4A, dimension A can be less than dimension B, and dimension B can be less than dimension C. For example only, dimension A can be on the order of about 0.030 inches, dimension B can be on the order of about 0.050 inches, and dimension C can be on the order of about 0.060 inches.

Figure 5:
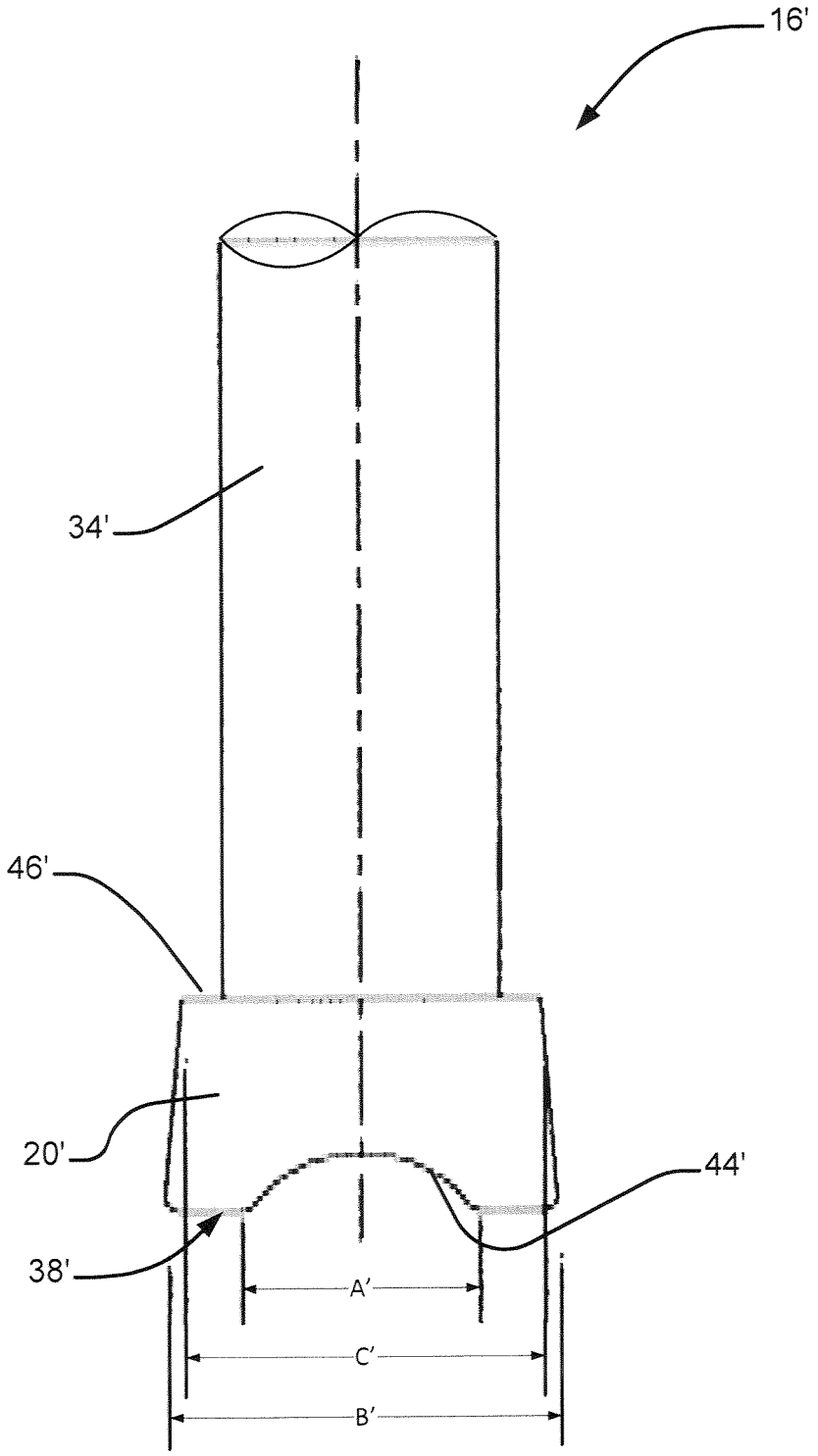
FIG. 5 is a front view of an alternative embodiment of an electrical conductor according to the principles of the present disclosure.
Figure 6:
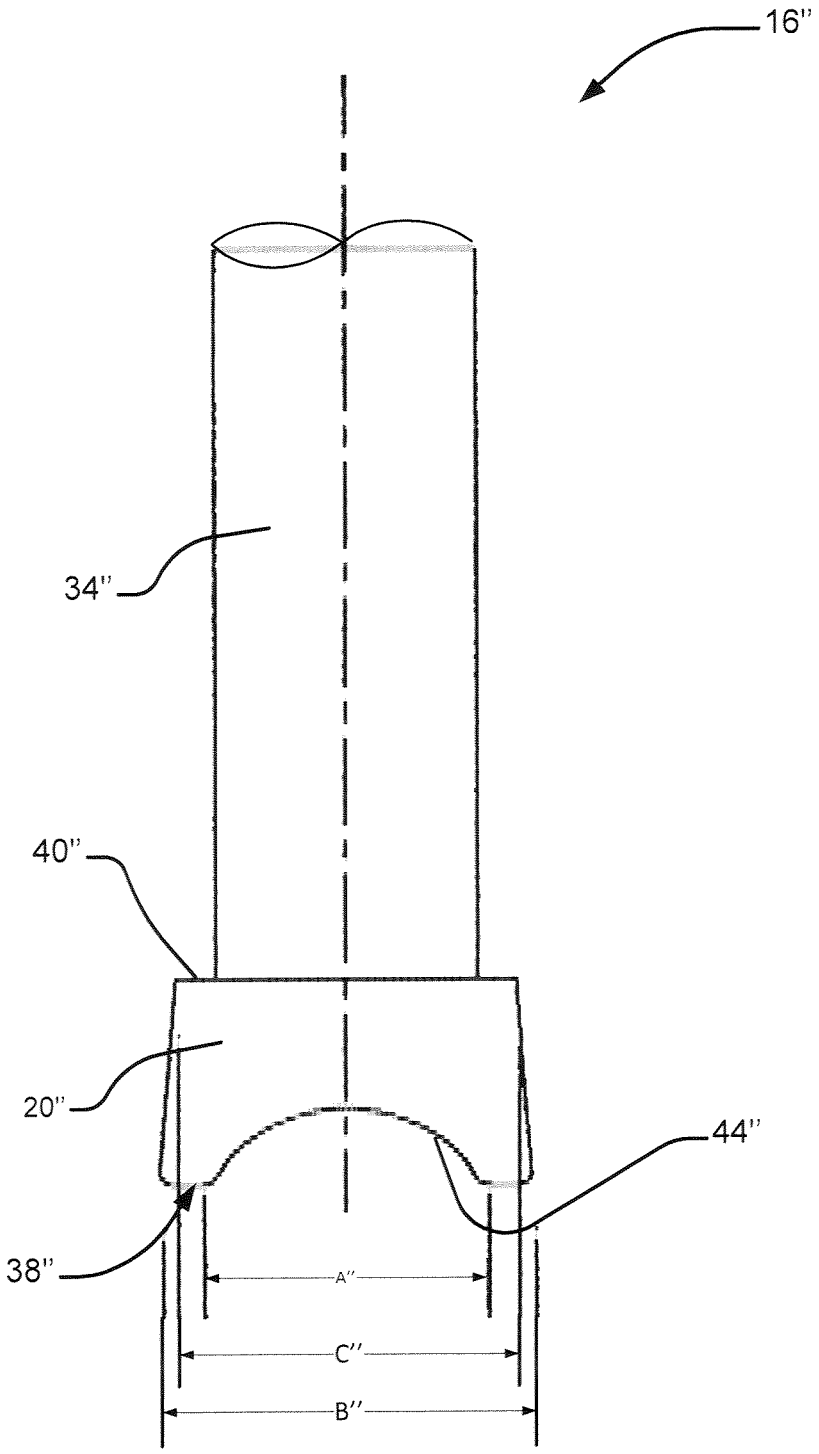
FIG. 6 is a front view of another alternative embodiment of an electrical conductor according to the principles of the present disclosure.

Alternative embodiments of a second electrical conductor 16' and 16" are shown in FIGS. 5 and 6. As shown in FIGS. 5 and 6, the dimension B', B" can be larger than the dimension C', C" of the shoulder 40', 40". Second electrical conductors 16', 16" are generally constructed in a manner similar to the second electrical conductor 16, and so like reference numerals identify like features. The second electrical conductors 16', 16" can include shaft portions 34', 34" and head portions 36', 36". The head portions 36', 36" can include contact surfaces 38', 38" and shoulder portions 40', 40". The contact surfaces 38', 38" can further comprise annular portions 42', 42" created by central concave portions 44', 44" in the distal ends 20', 20" of the head portions 36', 36" having diametrical dimensions A', A". The head portions 36', 36" can have outer diameters of B', B" and the shoulder portions 40', 40" can have an outer diameter of C', C".

As illustrated in FIG. 5, dimension A' can be less than dimension B', dimension C' can be less than dimension B', and dimension A' can be less than dimension C'. For example only, dimension A' can be on the order of about 0.030 inches, dimension B' can be on the order of about 0.060 inches, and dimension C' can be on the order of about 0.050 inches.

As illustrated in FIG. 6, the central concave portion 44" can have a larger diametrical dimension than that of central concave portions 44 and 44', thereby resulting in a narrower dimensioned annular portion 42". Dimension A" can be less than dimension B", dimension C" can be less than dimension B", and dimension A" can be less than dimension C". For example only, dimension A" can be on the order of about 0.040 inches, dimension B" can be on the order of about 0.060 inches, and dimension C" can be on the order of about 0.050 inches.

Figure 7:
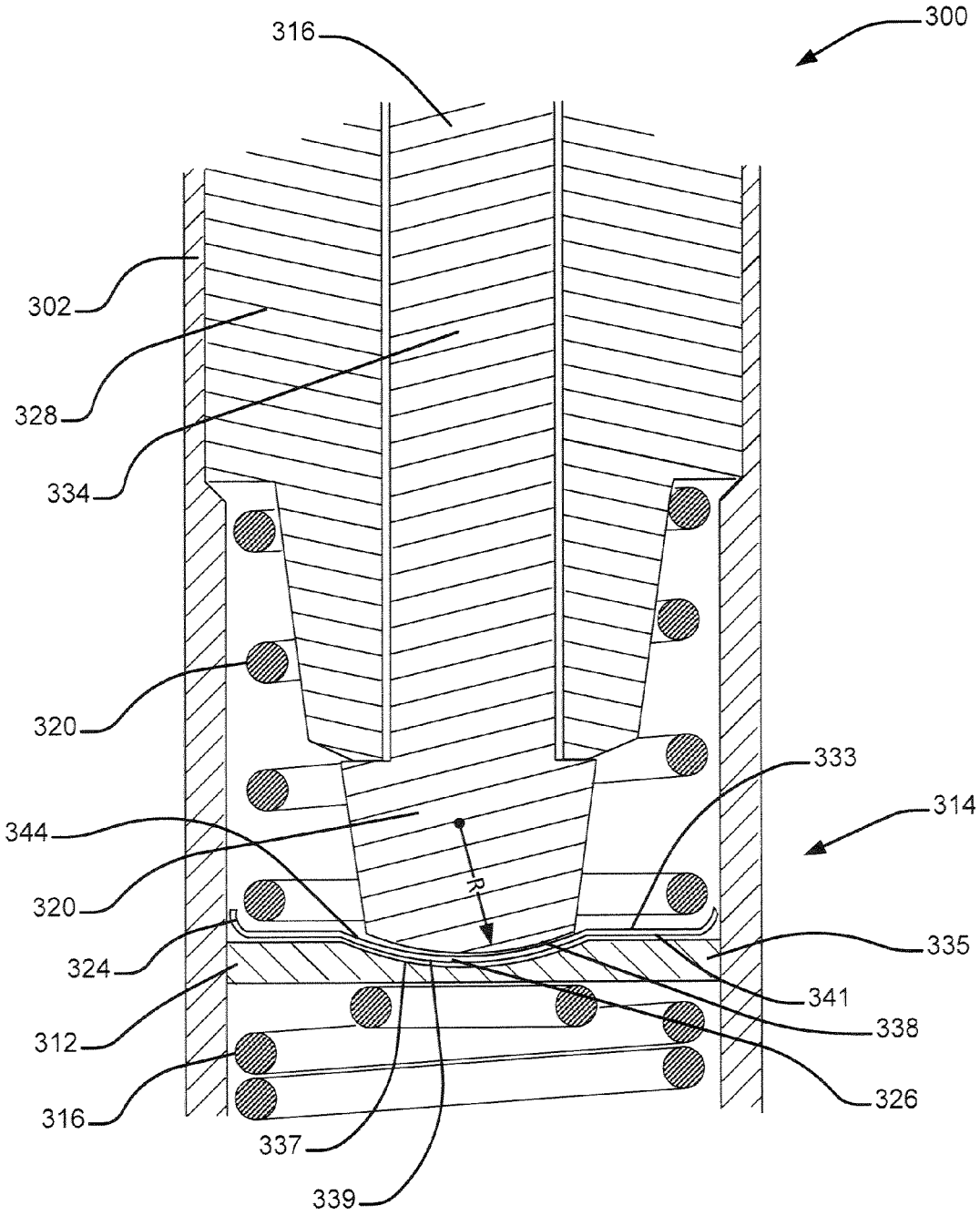
FIG. 7 is a cross-sectional partial front view of an alternative embodiment of a thermal cut-off device according to the principles of the present disclosure.

Referring now to FIG. 7, an enlarged partial cross-sectional view of an alternative TCO device 300 according to the principles of the present disclosure is illustrated. The alternative TCO device 300 includes the same general components and operates in the same general manner as the TCO devices 1, 100 previously described. The TCO device 300 is shown in its normal operating state such that the electric circuit through the TCO device 300 is in an uninterrupted condition.

FIG. 7 shows a second electrical conductor or isolated lead 316 including a shaft portion 334 and a distal end 320 having a convex contact surface 338. A current interruption assembly 314 (only partially shown), which actuates or "trips" to break the continuity of the electric circuit through the TCO device 300, includes a sliding contact member 326, formed of electrically conductive material, such as a metal, that is disposed inside the case 302 in peripheral sliding engagement with the internal surface of the case 302 to provide electrical contact therebetween. In its normal operating condition, the TCO device 300 is at a temperature that is below its predetermined threshold set-point temperature. As such, the sliding contact member 326 is disposed in electrical contact with the terminal end 320 of the second electrical conductor 316.

The sliding contact member 326 can include on first side 333 a concave portion 344 that correspondingly engages with the convex contact surface 338 of the second electrical conductor 316. In this regard, the concave portion 344 and the convex contact surface portion 338 can have substantially the same radius of curvature R so that the respective mating surfaces closely correspond to one another so that the second electrical conductor 316 at its contact surface portion 338, and the sliding contact member 326 at its concave portion 344, nest together in close contact over a large surface area. The concave portion 344 together with the convex contact surface 338 increase the area of direct surface contact between the sliding contact member 326 and the second electrical conductor 316 and provide performance and manufacture benefits not available in prior know TCO devices.

Optionally, the disk member 335 can also include a concave indentation 337 that correspondingly engages a convex portion 339 of a second side 341 of the sliding contact member 326, which is located opposite to the concave portion 344. The concave indentation 337 of the disk member 335 can also have a radius of curvature that is substantially the same as the radius of curvature of the concave portion 344 and the convex contact surface portion 338. This optional configuration for the disk member 335 could improve the manufacturability of the TCO device 300 and, in particular, the current interruption assembly 314. Of course, the disk member 335 can also be configured as shown in the TCO 1 of FIG. 3.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same can also be varied in many ways. Such variations are not to be regarded as a departure from the disclosure, and all such modifications are intended to be included within the scope of the disclosure.

What is claimed is:

1. A thermal cut-off device, comprising:

a case extending along a longitudinal axis from a first end to a second end;

a first electrically conductive member disposed at the first end of the case and extending from the case in a direction along the longitudinal axis;

a thermally responsive member comprising a non-electrically conductive material that transitions from a solid physical state to a non-solid physical state at or above a threshold temperature;

a second electrically conductive member disposed at the second end of the case, extending from the case in a direction along the longitudinal axis, and comprising a contact surface at a distal end thereof;

an electrically conductive, moveable contact disposed between the thermally responsive member and the second electrically conductive member;

a first biasing member disposed between the thermally responsive member and the moveable contact, the first biasing member biasing the moveable contact in a direction along the longitudinal axis toward the second electrically conductive member; and a second biasing member disposed between the moveable contact and the second end of the case, the second biasing member directly engaging the moveable contact and biasing the moveable contact in a direction along the longitudinal axis away from the second electrically conductive member;

wherein the distal end of the second electrically conductive member comprises a concave portion and the contact surface comprises a generally flat, annular portion that encircles a periphery of the concave portion; and wherein when the thermally responsive member is below the threshold temperature and the thermal cut-off device is operable to conduct electrical current, the annular portion of the contact surface directly engages the moveable contact; and wherein when the thermally responsive member is above the threshold temperature and the thermal cut-off device is operable to interrupt electrical current, the annular portion of the contact surface is separated from the moveable contact.

2. The thermal cut-off device of claim 1, wherein the concave portion is located near a central portion of the distal end of the second electrically conductive member, and the second electrically conductive member does not engage the moveable contact at the central portion.

3. The thermal cut-off device of claim 2, wherein the distal end further comprises a shoulder portion opposite the contact surface, and wherein a diameter of the shoulder portion is not greater than a diameter of the contact surface.

4. The thermal cut-off device of claim 2, wherein the distal end further comprises a shoulder portion opposite the contact surface, and wherein a diameter of the shoulder portion is greater than a diameter of the contact surface.

5. The thermal cut-off device of claim 2, wherein the distal end further comprises a shoulder portion opposite the contact surface, and wherein a diameter of the shoulder portion is less than a diameter of the contact surface.

6. The thermal cut-off device of claim 1, wherein the thermally responsive member comprises an organic compound;

wherein below the threshold temperature the thermally responsive member is a solid in the form of a pellet and opposes the bias of the first biasing member and of the second biasing member such that the movable contact is biased into engagement with the second current conducting member; and wherein at or above the threshold temperature the thermally responsive member is a liquid or a gas and ceases to oppose the bias of the first biasing member and the second biasing member such that the moveable contact is biased out of engagement and moves away from the second current conducting member.

7. The thermal cut-off device of claim 1, further comprising a first disk disposed between the thermally responsive member and the first biasing member, and a second disk disposed between the first biasing member and the moveable contact.

8. A thermal cut-off device for interrupting an electric circuit at a threshold temperature, comprising:

a case extending along a longitudinal axis;

a first lead disposed at a first end of the case and extending from the case in a direction along the longitudinal axis;

a second lead disposed at a second end of the case and extending from the case in a direction along the longitudinal axis, and comprising a contact surface at a distal end thereof;

a current interruption assembly comprising a moveable, electrically conductive contact engaging an interior wall of the case and biased against the contact surface of the second lead at a temperature below the threshold temperature;

wherein the distal end of the second lead comprises a concave portion and the contact surface comprises a generally flat portion about a perimeter of the distal end of the second lead;

wherein when the thermal cut-off device is at a temperature below the threshold temperature, the contact surface at the distal end of the second lead directly engages the moveable contact and the current interruption assembly is operable to conduct electrical current therethrough; and wherein when the thermal cut-off device is at a temperature at or above the threshold temperature, the contact surface at the distal end of the second lead is separated from the moveable contact and the current interruption assembly is inoperable to conduct electrical current therethrough.

9. The thermal cut-off device of claim 8, wherein the concave portion is located near a central portion of the distal end of the second lead, and the contact surface does not engage the contact at the central portion of the distal end of the second lead.

10. The thermal cut-off device of claim 8, wherein the current interruption assembly further comprises:

a thermally responsive member comprising a non-electrically conductive material that transitions from a solid physical state to non-solid physical state at or above the threshold temperature;

a first biasing member disposed between the thermally responsive member and the moveable contact, the first biasing member biasing the moveable contact in a direction along the longitudinal axis toward the second electrically conductive member; and a second biasing member disposed between the moveable contact and the second end of the case, the second biasing member biasing the contact in a direction along the longitudinal axis away from the second electrically conductive member.

11. The thermal cut-off device of claim 10, further comprising a first disk disposed between the thermally responsive member and the first biasing member, and a second disk disposed between the first biasing member and the moveable contact.

* * * * *